US008881406B2

(12) United States Patent
Glezerman

(10) Patent No.: US 8,881,406 B2
(45) Date of Patent: Nov. 11, 2014

(54) SHAVING DEVICE WITH DUAL CUTTING ELEMENTS

(76) Inventor: Abraham Glezerman, Tel-Aviv (IL)

( * ) Notice: Subject to any disclaimer, the term of this patent is extended or adjusted under 35 U.S.C. 154(b) by 204 days.

(21) Appl. No.: 13/166,530

(22) Filed: Jun. 22, 2011

(65) Prior Publication Data

US 2012/0291289 A1 Nov. 22, 2012

Related U.S. Application Data

(60) Provisional application No. 61/487,088, filed on May 17, 2011.

(51) Int. Cl.

| | |
|---|---|
| ***B26B 21/00*** | (2006.01) |
| ***B26B 21/22*** | (2006.01) |
| ***B26B 21/40*** | (2006.01) |
| ***B26B 21/28*** | (2006.01) |
| ***B26B 21/52*** | (2006.01) |

(52) U.S. Cl.

CPC ..... *B26B 21/4037* (2013.01); *B26B 21/28* (2013.01); *B26B 21/4081* (2013.01); *B26B 21/527* (2013.01); *B26B 21/222* (2013.01); *B26B 21/4043* (2013.01)

USPC ..... 30/34.05; 30/34.1; 30/49; 30/50

(58) Field of Classification Search

CPC ..... B26B 21/00; B26B 21/22; B26B 21/222

USPC ..... 30/34.1, 526, 50, 29.5, 49, 537, 34.05

See application file for complete search history.

(56) References Cited

U.S. PATENT DOCUMENTS

| | | | | |
|---|---|---|---|---|
| 1,383,783 | A | 7/1921 | Billingsley | |
| 3,934,299 | A * | 1/1976 | Regester | 15/104.94 |
| 4,768,531 | A | 9/1988 | Broussard | |
| 4,989,328 | A | 2/1991 | Sokoloff | |
| 5,287,624 | A | 2/1994 | Mondo et al. | |
| 5,307,564 | A | 5/1994 | Schoenberg | |
| 5,386,750 | A | 2/1995 | Morrison | |
| 5,542,178 | A | 8/1996 | Harkleroad | |
| 5,762,515 | A | 6/1998 | Mele | |
| 6,052,905 | A | 4/2000 | Branchinelli et al. | |
| 6,499,218 | B2 | 12/2002 | Rocha | |
| 6,560,876 | B2 | 5/2003 | Carr | |
| 7,191,523 | B2 | 3/2007 | Miyazaki et al. | |
| 7,669,511 | B2 | 3/2010 | King | |
| 7,721,451 | B2 | 5/2010 | Psimadas et al. | |
| 7,730,619 | B2 | 6/2010 | Ozenick | |
| 2004/0158990 | A1 * | 8/2004 | Heide | 30/34.1 |
| 2005/0011072 | A1 * | 1/2005 | Segrea | 30/34.05 |
| 2005/0172490 | A1 * | 8/2005 | Yiu | 30/34.1 |

(Continued)

FOREIGN PATENT DOCUMENTS

| | | |
|---|---|---|
| GB | 2471676 | 1/2011 |
| WO | WO2007/086092 | 8/2007 |

*Primary Examiner* — Omar Flores Sanchez

(74) *Attorney, Agent, or Firm* — Leason Ellis LLP

(57) ABSTRACT

An accessory for use with a shaving device includes a hollow flexible body having an open first end constructed to receive a free end of the shaving device that is opposite a razor blade and a closed second end. The closed second end has an arcuate shape. The accessory also includes a plurality of microblades disposed at the closed second end along an arcuate-shaped exterior surface thereof for trimming hair located in difficult to reach rounded facial areas.

15 Claims, 4 Drawing Sheets

(56) References Cited

U.S. PATENT DOCUMENTS

| | | | | |
|---|---|---|---|---|
| 2007/0006463 | A1* | 1/2007 | Pennella | 30/34.1 |
| 2007/0283567 | A1 | 12/2007 | Magli | |
| 2008/0016691 | A1* | 1/2008 | Pennella et al. | 30/34.1 |
| 2009/0000124 | A1* | 1/2009 | Micinilio et al. | 30/34.1 |
| 2009/0019700 | A1 | 1/2009 | Shushan | |
| 2010/0011585 | A1* | 1/2010 | Maichel et al. | 30/34.1 |
| 2010/0064520 | A1 | 3/2010 | Park et al. | |
| 2011/0041342 | A1 | 2/2011 | Starr | |
| 2012/0174408 | A1* | 7/2012 | Blaustein et al. | 30/34.1 |

* cited by examiner

SHAVING DEVICE WITH DUAL CUTTING ELEMENTS

CROSS-REFERENCE TO RELATED APPLICATIONS

This application claims the benefit of U.S. Patent Application Ser. No. 61/487,088, filed May 17, 2011, which is hereby incorporated by reference in its entirety.

TECHNICAL FIELD

The present invention relates to razors and in particular, to a razor having dual cutting elements with one being designed for shaving difficult facial areas.

BACKGROUND

Shaving razors have been known in a varied of different forms. Different razors are designed to combat different shaving challenges that arise as part of the normal shaving routine. Uni-directional and bi-directional razor blade shaving devices are common and have long been known and used for a variety of shaving purposes. A uni-directional straight edge razor blade with an in-line handle has been in use in barber shops for more than a century. Over the past 50 years or so the predominant shaving technique is a wet shave that is assisted by a manual wet-shaving blade device in the form of a classic T-bar razor. A T-bar razor includes an elongated razor head and an in-line handle, which runs perpendicular from the bottom edge of the razor's blade head.

Recent developments in razors include more advanced razor blades that are provided in cartridge form and is designed to be disposed of after a certain number of uses. Multi-blade razors blades are the norm today with the number of blades ranging from 2-5 blades.

However, despite the increase in the number of blades and an increase in the technology that is behind the razor blade design, there are still different facial areas that are difficult to shave. In particular, when using a wet shaving device, users often find it difficult to achieve a thorough shave at certain facial locations. This is mainly due to the fact that the natural rounded contours of the face are not easily accessible to the horizontal shape of the blade itself. Shaving is particularly difficult at the sloped location where the nostrils meet the upper part of the lip.

The present invention addresses and overcomes these deficiencies and provides a device that is designed to shave those facial areas that are difficult to shave with traditional manual hand-held shaving devices (e.g., a T-bar razor).

SUMMARY

An accessory for use with a shaving device includes a hollow flexible body having an open first end constructed to receive a free end of the shaving device that is opposite a razor blade and a closed second end. The closed second end has an arcuate shape. The accessory also includes a plurality of micro-blades disposed at the closed second end along an arcuate-shaped exterior surface thereof for trimming hair located in difficult to reach rounded facial areas.

In another embodiment, a shaving device includes an elongated handle having a first end and an opposing second end. A first cutting element in the form of a razor blade is mounted to the first end of the handle and a secondary cutting element is formed at the second end of the handle. The second cutting element is defined by an arcuate body located at the second end and includes an arcuate shaped exterior surface. The secondary cutting element further includes a plurality of micro-blades that are disposed along the arcuate-shaped exterior surface for trimming hair located in difficult to reach rounded facial areas.

These and other aspects, features and advantages shall be apparent from the accompanying Drawings and description of certain embodiments of the invention.

DETAILED DESCRIPTION OF CERTAIN EMBODIMENTS OF THE INVENTION

Figure 1:
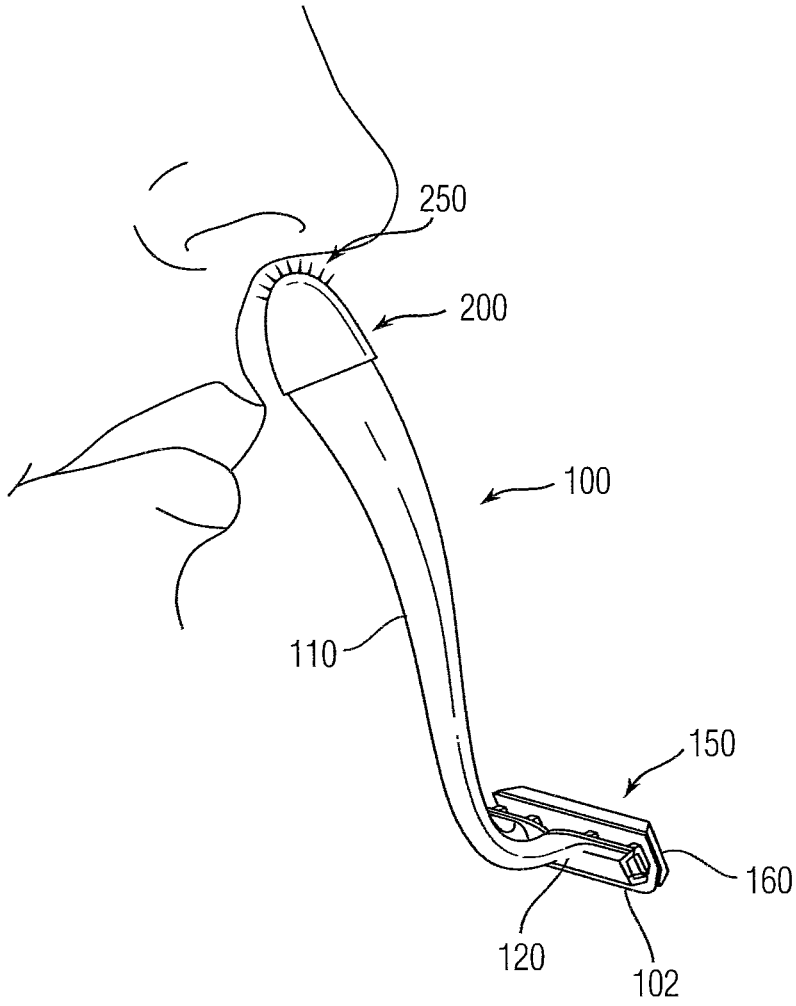
FIG. 1 is a side perspective view of a shaving device with a cutting accessory coupled thereto according to one embodiment of the present invention.

FIG. 1 is an exploded view of a traditional shaving device 100 that includes a first cutting element 150 and an accessory 200 that includes a second cutting element 250 and is intended for use with the shaving device 100.

Referring to FIGS. 1-5, the shaving device 100 has a first end 102 and an opposing second end 104 and includes an elongated handle 110 and a head 120 at the first end 102. The head 120 carries the first cutting element 150 and in many of today's shaving devices 100, the head 120 is designed to be detachably attached to a razor cartridge 160. The razor cartridge 160 includes at least one and preferably a plurality of razor blades 164. The blades 164 are horizontally oriented within a housing 165 of the razor cartridge 160 and the razor cartridge 160 typically has a rectangular shape. Despite the fact that the razor cartridge 160 is pivotally attached to the handle 110, there are still many facial areas where it is difficult for the blades 164 to adequately contact and cut facial hair. For example, the rounded contours of the face make it very difficult to obtain a clean shave in all facial areas, such as the sloped location where the nostrils meet the upper part of the lip.

The elongated handle 110 can have different ergonomic designs to provide a handle that is easy to grip and hold and manipulate during the shaving action. The accessory 200 of the present invention is constructed to mate with and be coupled to the first end 102 of the handle 110. The accessory 200 is in the form of a flexible sleeve or glove-like structure that is intended to be disposed over the handle 110 at the first end 102.

The accessory 200 is thus a flexible skin or membrane that is shaped to have a hollow construction in that it includes an open first end 202 and a closed second end 204. The accessory 200 has a hollow interior that receives the second end 104 of the shaving device 100. The flexibility of the accessory 200 allows the accessory to be stretched over the second end 104 so that the second end 104 is received within the hollow interior. When the user releases the accessory 200, the resiliency causes the accessory 200 to return to its original state (rest position/unstretched position). The accessory 200 can thus take the form of a glove-like or cap-like structure that receives and is secured to the second end 104 of the shaving device 100.

The accessory 200 can be formed of any number of different types of material, including synthetic materials (polymeric materials) and rubber materials. In one embodiment, the accessory 200 is in the form of a rubber cap.

In the illustrated embodiment, the accessory 200 has a dome-shape. Thus, the accessory 200 can generally have the feel and look of a rubber thimble for a fingertip, etc.

The accessory 200 has an exterior (outer) surface 210 that faces away from the handle 110. In accordance with the present invention, a plurality of micro-blades 300 are disposed along at least a portion of the exterior surface 210. In particular, a distal tip at the closed second end 204 includes a plurality of micro-blades 300. The micro-blades 300 extend radially outward from the second end 204 of the accessory 200. The micro-blades 300 can at least cover the top portion of the dome-shaped accessory body. The micro-blades 300 are thus formed along a convex surface.

Figure 2:
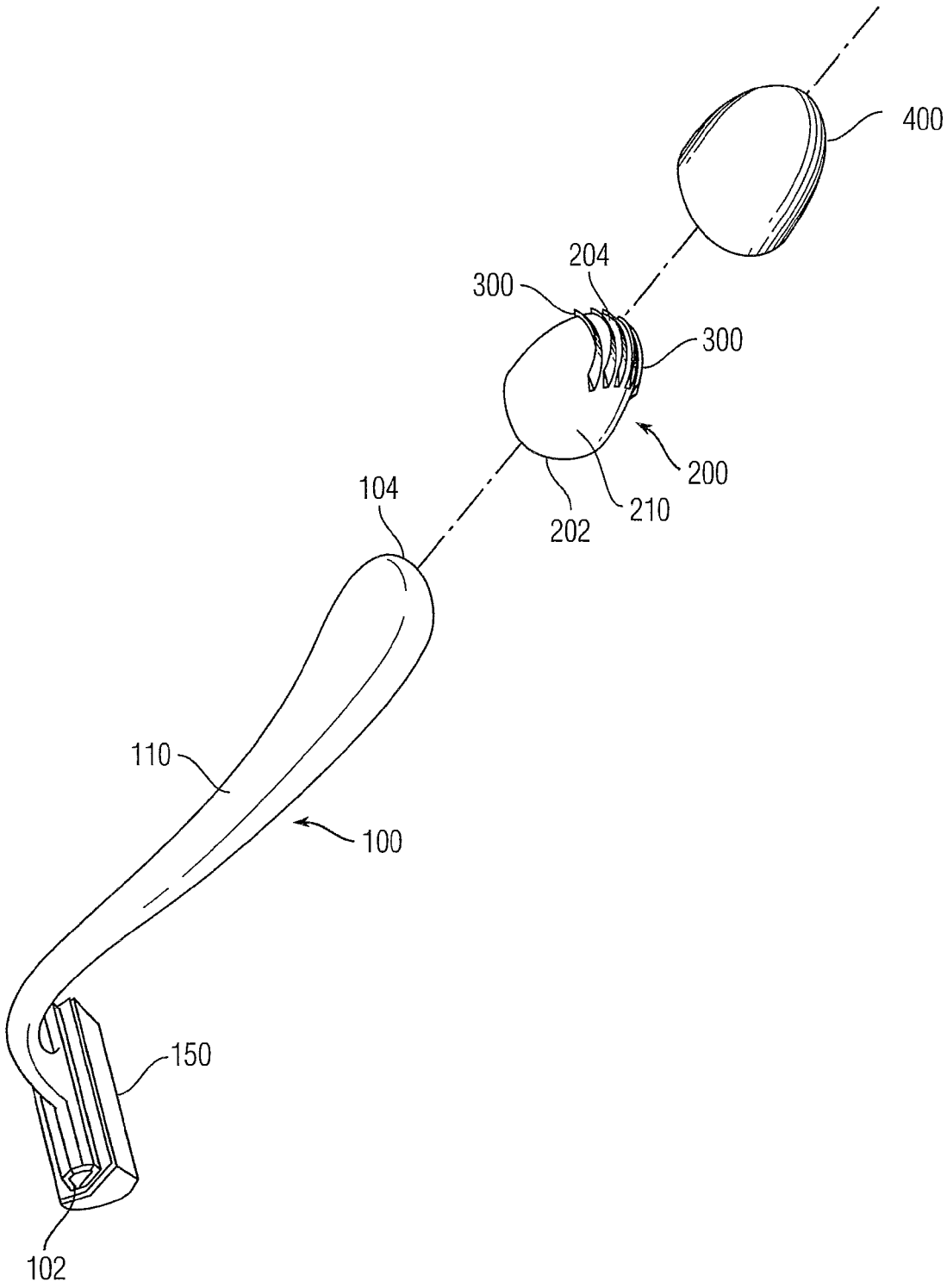
FIG. 2 is an exploded perspective view of the accessory of FIG. 1 for use with a conventional shaving device.
Figure 3:
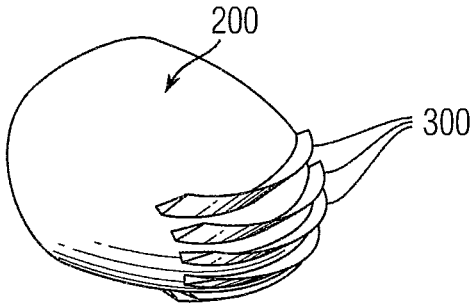
FIG. 3 is a perspective view of the accessory of FIG. 1.

As shown best in FIGS. 2-3, since the micro-blades 300 are disposed across an arcuate-shaped exterior surface, the micro-blades 300 themselves have/assume an arcuate shape. In other words, the micro-blades 300 can have a curved shape with the top edge having a convex shape.

The micro-blades 300 can have different lengths in that the micro-blades 300 can represent miniature horizontal blades that extend across substantially the entire width (diameter) of the accessory body in the top dome-shaped portion thereof or the micro-blades 300 can more represent a plurality of blades that do not extend substantially across a width of the body of the accessory 200 but only extend across a portion thereof and can thus represent micro-blade segments 300. The micro-blades 300 can thus represent miniature blades that can be oriented across the distal tip of the body of the accessory 200 and can include portions that are oriented at least generally parallel to one another along portions of the arcuate (convex) surface of the accessory body 200.

The micro-blades 300 can be formed of any number of different materials including but not limited to metal, plastic, etc., so long as the micro-blades 300 are sufficiently constructed to cut/trim facial hair.

The micro-blades 300 can be integrally formed with the body of the accessory 200 using any number of different techniques, including an overmolding process when the micro-blades 300 are in the form of small metal blades. The micro-blades 300 are thus embedded within the body of the accessory 200. In addition, the micro-blades 300 can be formed as a flexible strip of blades that are attached along the exterior surface of the accessory body using traditional means, including the use of an adhesive.

Since the micro-blades 300 are attached to the flexible body of the accessory 200 at different locations along the exterior surface 210 thereof, the micro-blades 300 can flex as the body of the accessory 200 flexes. When the accessory 200 has an arcuate exterior surface 210, as shown, the micro-blades 300 are likewise formed along an arc and thus, the micro-blades 300 do not necessarily have to be parallel, horizontal blades as in the case of a traditional blade 164 of the first cutting element 150. The second cutting element 250 thus has a rounded blade appearance that permits the second cutting element 250 to reach the rounded, hard to reach facial features.

It will be appreciated that the micro-blades 300 are set in the flexible body of the accessory 200 at selected and appropriate angles relative to the body such that the cutting edges of the micro-blades 300 do not adversely impact the skin of the user when a cutting action is performed. In other words and similar to how main blades 164 are set in the a traditional razor cartridge, the micro-blades 300 are angled so that when one or more micro-blades 300 are placed in contact with the skin of the user and the micro-blades 300 are moved over the skin surface, a clean cut of hair results and the skin is not irritated. In other words, the micro-blades 300 are designed so that the function much like the main blades 164 with the exception that they are disposed along a curved (arcuate) surface and thus can mate more effectively with the rounded surfaces of the face that are otherwise very difficult to access with the main blades 164, which as described above have a box-like appearance.

In addition, it will be appreciated that the main blades 164 and the micro-blades 300 can have different degrees of sharpness in that the main blades 164 can be sharper than the micro-blades 300. This permits the micro-blades 300 to be set at different angles compared to the main blades 164 and not adversely impact the skin of the user during a cutting motion where one or more micro-blades 300 are placed into contact with and moved along the surface of the skin to cut/trim facial hair.

One advantage that the accessory 200 provides is its versatility in that it is designed to be used with any number of different types of shaving devices 100 (razors) due to the fact that the body of the accessory 200 can stretch and be fit over free, distal ends of razor handles. Thus, the accessory 200 can be marketed as an accessory that can be purchased and used with any number of different razor handles. The consumer simply disposes the accessory 200 on the free second end 104 of the handle 110 much like a thimble is inserted on a fingertip. In other words, the open end 202 of the accessory body can be rolled back to allow the handle end to be more easily inserted and then once the second end 104 reaches the closed end 204 of the accessory or is close thereto, the rolled-up accessory body is then unrolled along the handle 110.

FIG. 2 shows the use of an optional, protective cap 400 which can be provided and used to cover the micro-blades 300 and the accessory 200 when they are not in use but remain coupled to the handle 110.

Figure 4:
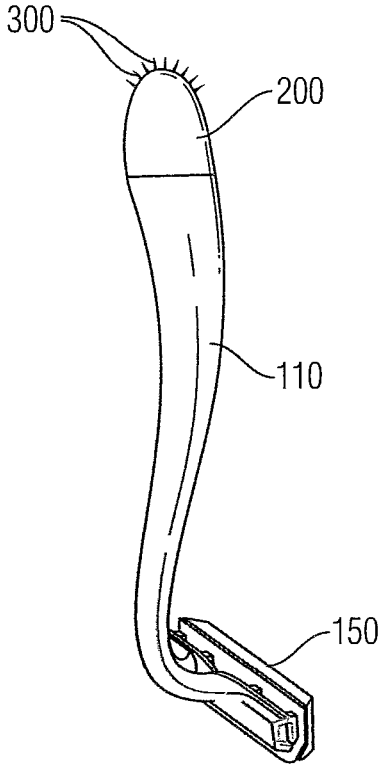
FIG. 4 is a side perspective view of a shaving device with a cutting accessory according to another embodiment of the present invention.
Figure 5:
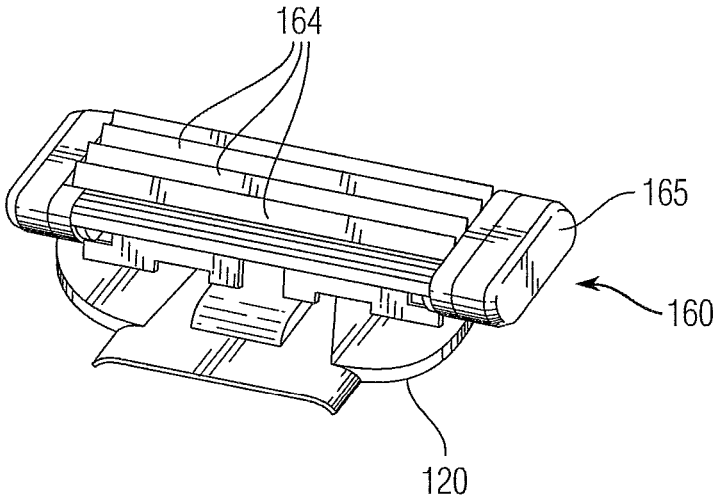
(PRIOR ART) Fig. 5
FIG. 5 is a perspective view of a conventional razor blades cartridge.

Alternatively and as shown in FIG. 4, the accessory 200 can be integrally formed with the handle 110 so as to define the free second end 104 of the device 100. In other words, the accessory 200 is not a separate member that is attached and is removable from the razor handle but instead, the accessory 200 is formed as part of the handle. In this embodiment, the accessory 200 can still have a dome shape and the micro-blades 300 are disposed along at least along a part of the exterior surface 210.

The accessory 200 can be formed integral with the handle 100 using conventional techniques, such as various molding techniques. For example, the accessory 200 and handle 110 can be formed as part of a common molding process; however, it will be appreciated that the accessory 200 can be formed of a different material than the handle 110 even in this embodiment. Thus, the accessory 200 can still be formed of a resilient material, such as rubber or a polymeric material, while the handle 110 can be formed of a rigid material, such as a rigid plastic. As in the previous embodiment, the micro-blades 300 are embedded within the body of the accessory 200. Since the accessory 200 is preferably dome-shaped, the micro-blades 300 will also be formed along an arcuate surface and thus, can be more easily disposed within and along the rounded features of a human face where it is difficult for a conventional razor blade to function as described herein.

In this embodiment in which the accessory is an integral part of the razor handle that is not intended to be removed, a protective cap 400 (FIG. 2) can be provided and used to cover the micro-blades 300 when they are not in use. The protective cap 400 can thus be frictionally held on the integral accessory and can be easily removed when the user desires to trim hair with the integral accessory. Once the protective cap 400 is removed, the user simply turns the razor around and holds the handle and positions the integral accessory toward the user's face. The micro-blades 300 are then brought into contact with the user's face.

The present invention thus provides an effective cutting element that is for use with a traditional shaving device and is designed to trim/cut facial hair in hard to reach facial areas. The accessory can be easily installed on an existing shaving device or it can be made as an integral part of the shaving device.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. An accessory for use with a shaving device comprising:

a hollow flexible stretchable body having an open first end constructed to receive a free end of the shaving device that is opposite a razor blade and a closed second end, the closed second end having an arcuate shape with a curved section defining a distalmost portion of the body, whereby the body is configured to stretch and receive the free end of the shaving device for attaching the body to the shaving device; and a plurality of micro-blades disposed at the closed second end along an arcuate-shaped exterior surface of the curved section for trimming hair located in difficult to reach rounded facial areas.

2. The accessory of claim 1, wherein the hollow flexible body is formed of rubber.

3. The accessory of claim 1, wherein the hollow flexible body is formed of a polymeric material.

4. The accessory of claim 1, where the micro-blades are at least partially embedded within the hollow flexible body.

5. The accessory of claim 1, wherein portions of the micro-blades are oriented at least substantially parallel to another along the arcuate-shaped exterior surface.

6. The accessory of claim 1, wherein the open first end of the hollow flexible body can be rolled on top of itself.

7. The accessory of claim 1, wherein the micro-blades are formed of metal.

8. A shaving device comprising:

an elongated handle having a first end and an opposing second end;

a first cutting element in the form of a razor blade mounted to the first end of the handle; and a secondary cutting element formed at the second end of the handle, the second cutting element being defined by an arcuate body located at the second end and including an arcuate shaped exterior surface, the secondary cutting element further including a plurality of micro-blades that are disposed along the arcuate-shaped exterior surface that represents a distalmost portion of the body for trimming hair located in difficult to reach rounded facial areas, wherein the arcuate body is formed of a flexible, stretchable material to allow the arcuate body to be stretched over the second end of the elongated handle resulting in the arcuate body being retained on the second end of the elongated handle.

9. The shaving device of claim 8, further including a removable protective cap that covers the secondary cutting element.

10. The shaving device of claim 8, wherein the micro-blades are at least partially embedded therein such that the micro-blades flex.

11. The shaving device of claim 8, wherein the micro-blades are formed of metal.

12. The shaving device of claim 8, wherein portions of the micro-blades are oriented at least substantially parallel to another along the arcuate-shaped exterior surface.

13. The shaving device of claim 8, wherein the arcuate body is dome shaped.

14. The shaving device of claim 8, wherein the micro-blades are formed as part of a flexible strip that is bonded to the arcuate-shaped exterior surface and assumes the arcuate shape of the exterior surface of the body as a result of being fixedly attached to the exterior surface of the body.

15. The accessory of claim 1, wherein the body is formed of a material that is moldable and the micro-blades are embedded within the body as a result of a molding process.

* * * * *